US005921163A

United States Patent [19]

McInnes et al.

[11] Patent Number: 5,921,163

[45] Date of Patent: Jul. 13, 1999

[54] BAGEL SLICING APPLIANCE

[76] Inventors: Thomas A. McInnes, 7816 Ruxwood Rd.; Douglas Pinney, 2020 Skyline Rd., both of Ruxton, Md. 21204; Louis Toth, 3220 Regents Row, West Friendship, Md. 21794

[21] Appl. No.: 08/845,595

[22] Filed: Apr. 25, 1997

Related U.S. Application Data

[60] Provisional application No. 60/016,067, Apr. 25, 1996.

[51] Int. Cl.[6] ..... B26D 3/00

[52] U.S. Cl. ..... 83/870; 83/167; 83/758; 83/932

[58] Field of Search ..... 83/167, 758, 870, 83/871, 932

[56] References Cited

U.S. PATENT DOCUMENTS

| | | | |
|---|---|---|---|
| 4,523,505 | 6/1985 | Polson | 83/713 |
| 5,440,959 | 8/1995 | Bindon et al. | 83/100 |
| 5,522,306 | 6/1996 | DeMars | 99/329 RT |
| 5,690,013 | 11/1997 | Kanarek et al. | 83/762 |
| 5,732,610 | 3/1998 | Halladay et al. | 83/871 |

*Primary Examiner*—Lee W. Young
*Assistant Examiner*—Kevin G. Vereene
*Attorney, Agent, or Firm*—Law offices of Royal W. Craig

[57] ABSTRACT

An improved appliance for slicing food articles, particularly baked goods and bagels in a uniform, quick and safe manner. The appliance includes a food receptacle which is slidably inserted into one end of a main housing and into which a food item such as a bagel is placed. A motorized cutting carriage is mounted on top of the main housing and extends a serrated dual-bladed slicing assembly horizontally over the food item. When power is applied, the blades of the slicing assembly begin reciprocating, and the entire cutting carriage is depressed downward in order to move the reciprocating blades of the slicing assembly through the food item . Once the food item is cut, the cutting carriage returns to its home position, the food receptacle is to slidably withdrawn, and the sliced food item is removed and consumed. In a second fully-automatic embodiment, the cutting carriage is self-driven downward and then upward (no manual depression is needed) in order to move the reciprocating blades of the slicing assembly through the food item. Both embodiments of the appliance require a minimum of space and facilitate the slicing operation without damage to the bagel. The appliances are efficient, quick, easy to clean, and above all, completely safe.

18 Claims, 14 Drawing Sheets

BAGEL SLICING APPLIANCE

CROSS REFERENCE TO RELATED APPLICATIONS

Priority of this application is based on provisional application Ser. No. 60/016,067, filed Apr. 25, 1996.

BACKGROUND OF THE INVENTION

1. Field of the Invention

The present invention relates to kitchen appliances and, more particularly, to a motorized food slicing appliance to simplify the cutting of bagels and other baked goods, and to increase safety.

2. Description of the Background

The conventional means for slicing food articles, particularly baked goods such as bagels, doughnuts and the like, entails a simple carving knife and cutting board. However, this engenders a significant safety hazard. Safety is especially compromised in the cutting of bagels, which are hard and round and thereby difficult to stabilize. It is recognized that bagel slicing is one of the foremost causes of household injury. Hospitals routinely treat an inordinate number of lacerated fingers caused thereby.

A number of machines and jigs for slicing bagels already exist in the prior art. These generally fall into two categories: 1) manual holding jigs or receptacles into which the bagel is placed to hold it during a conventional knife cutting operation; and 2) industrialized slicing machines designed to slice a large number of bagels or baked goods in an assembly-line manner.

Many of the former manually-operated devices include a receptacle having a pair of opposed slots into which is inserted a cutting instrument, which is then moved back and forth in action to slice the bagel while it is held by the receptacle. Specifically, U.S. Pat. No. 4,399,989 to Baillie shows a mechanical bagel press for securing bagels whilst cutting with a knife, and U.S. Pat. No. 4,807,505 to Campbell et al. shows a miter-box type manual bagel slicer for securing a bagel and guiding a knife. In these and other cases, the use of a separate knife to slice the bagel is not always convenient and leaves the risk of injury from the knife blade. Other variations attach the knife blade to the housing to facilitate the sawing action. Still others employ a special guided blade or make provision for rotating the bagel to facilitate slicing. Examples include U.S. Pat. No. 4,747,331 to Policella, which shows a mechanical bagel press for securing bagels whilst cutting with a pivotally mounted knife, and U.S. Pat. No. 5,431,078 to Ricard et al. which shows a manual guillotine-type bagel slicing jig. These and like devices still result in a labor intensive process and user interaction with a free-swinging blade. Injuries are still prevalent.

There are heavy commercial devices used by restaurants and the like. These industrialized devices entail automatically feeding bagels past rotating blades. They are designed for use where ample counter space and a high price tag are not obstacles. For example, U.S. Pat. No. 5,404,782 to Ryan et al. shows an automated slicer in which bagels or other baked goods are carried on a conveyer past two opposing horizontal blades. The baked goods are sliced by the blades and continue onward until they are ejected from the conveyer into a hopper. Similarly, U.S. Pat. No. 4,776,252 to Herlitzius shows an automated slicer in which bagels are carried on a conveyer to a rotary slicer. The bagels are sliced by adjustable blades and continue onward until they fall off the conveyer into a hopper.

It would be greatly advantageous to provide a compact motorized bagel slicing device adapted for home or light commercial use, thereby simplifying the slicing process and improving the safety thereof. While there have been efforts to achieve a balance between automation, safety, and simplicity, none as yet have yielded a satisfactory design. For instance, U.S. Pat. No. 4,546,686 to Losiowski shows a bagel slicing jig in which a bagel is inserted through an entrance door in advance of a pushing mechanism. The handle operated pushing mechanism urges the bun past a diagonal blade. After slicing, the bun is ejected from the side of the jig. U.S. Pat. No. 2,685,901 to Putzer shows a bun slicing machine in which a round bun is inserted in a slidable carriage. The carriage and bun are shifted via a handle such that the bun encounters a diagonal blade. After slicing, the bun falls into an exit hopper for removal. These devices remain bulky, difficult to use and clean, and expensive to manufacture. They could be better designed for simplicity, compactness, ease of operation, more economical manufacturing, and ease of cleaning. It is believed that a well-designed modular unit striking a better balance between manual and motorized operation would find a significant market.

SUMMARY OF THE INVENTION

In accordance with the above, it is an object of the present invention to provide an improved apparatus for slicing food articles, particularly baked goods and bagels in a uniform, quick and safe manner.

Another object of the invention is to provide an improved semi-automatic bagel slicer that requires a minimum of space and which facilitates the slicing operation without damage to the bagel.

Another object of the invention is to provide an improved bagel slicer which is efficient, quick, easy to clean, and above all, completely safe.

These and other objects are provided by an improved appliance for slicing food articles, particularly baked goods and bagels, in a uniform, quick and safe manner.

A first embodiment of the appliance includes a food receptacle which is slidably inserted into one end of a main housing and into which a food item such as a bagel may be placed. A motorized cutting carriage is mounted on top of the main housing and extends a serrated dual-bladed slicing assembly horizontally over the food item. When power is applied, the blades of the slicing assembly begin reciprocating, and the entire cutting carriage with extended dual-blade slicing assembly is depressed downward into the main housing in order to move the reciprocating blades through the food item. Once the food item is cut, the cutting carriage returns to its home position, the food receptacle can be slidably withdrawn, and the sliced food item is removed. The appliance requires a minimum of space and facilitates the slicing operation without damage to the bagel. The appliance is efficient, quick, easy to clean, and above all, completely safe.

A second completely automatic embodiment of the appliance is structurally similar to the first, and additionally includes a cutting carriage drive assembly actuated by the same motor in the cutting carriage for drawing the cutting carriage downward to cut the food item, self-reversing, and then returning to its home position. With this second embodiment, the entire cutting operation becomes fully automatic and the user can enjoy the greatest degree of convenience and safety.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
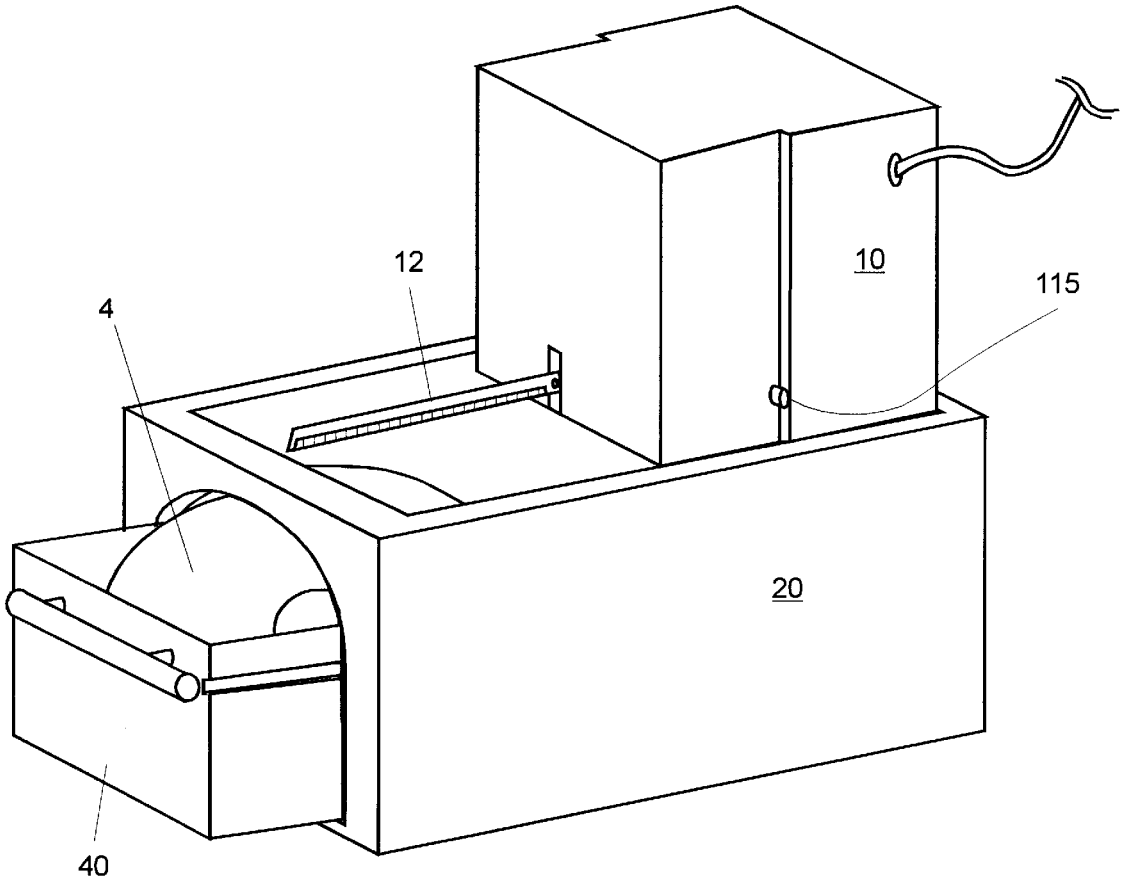
FIG. 1 is a front perspective view of a bagel slicing appliance in accordance with one embodiment of the present invention.

FIG. 1 is a front perspective view of a bagel slicing appliance in accordance with one embodiment of the present invention. The device generally includes a main housing 20 formed as a substantially rectangular enclosure. A bagel 4 or other food item is seated in a food receptacle drawer 40, which in turn is slidably inserted into one end of the main housing 20. A motorized cutting carriage 10 is mounted on top of the main housing 20 and is adapted for guided slidable depression into said housing. Cutting carriage 10 is spring-loaded such that after manual depression it will automatically return itself to the illustrated home position. A serrated dual-bladed slicing assembly 12 extends horizontally from the cutting carriage 10 within the confines of main housing 20. Dual-bladed slicing assembly 12 is actuated by a drive mechanism internal to the cutting carriage 10 (to be described) and is driven to reciprocate for slicing through the food item 4. In operation, the entire cutting carriage 10 is depressed downward in order to move the reciprocating blades of slicing assembly 12 through the food item 4. When the cutting carriage 10 is depressed, an on/off switch 115 is actuated and power is applied to the internal drive mechanism to begin reciprocation of the slicing assembly 12. Once the food item is cut, the spring-loaded cutting carriage 10 returns to its home position, on/off switch 115 is released, the food receptacle drawer 40 is slidably withdrawn, and the sliced food item 4 can be removed and consumed. The serrated dual-bladed slicing assembly 12 makes short work of the slicing and results in a clean uniform cut through the food item 4. The main housing 20 completely shields the user from the serrated dual-bladed slicing assembly 12, and no injury is possible.

Figure 2:
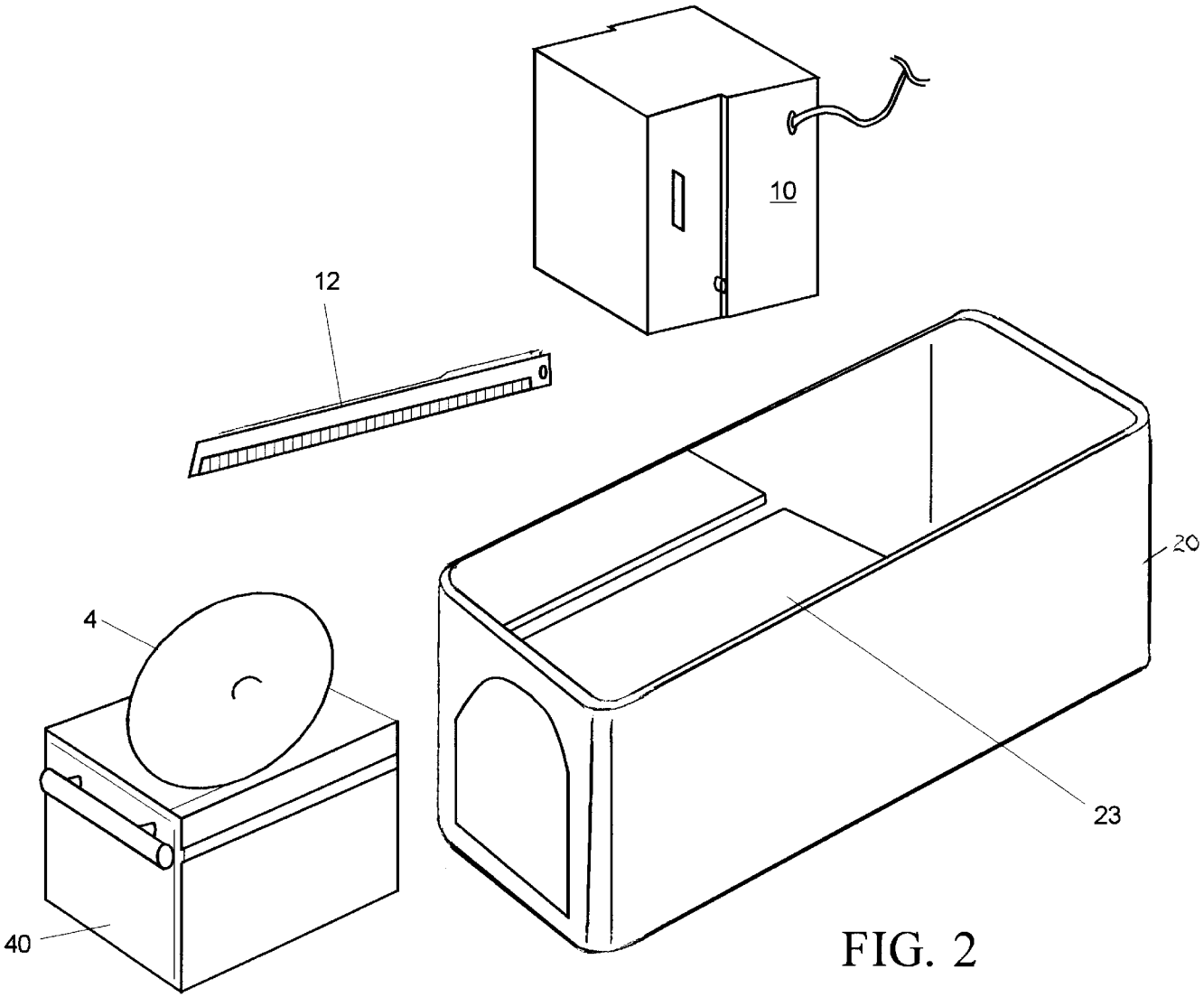
FIG. 2 is an exploded perspective view of the bagel slicing appliance of FIG. 1.

FIG. 2 is an exploded perspective view of the bagel slicing appliance of FIG. 1 that better shows the cooperation of the food receptacle drawer 40 as it is adapted for slidable insertion into one end of the main housing 20. Main housing 20 is here shown with a top wall 23 for added safety. Top wall 23 covers approximately the foremost half of the main housing 20 and is defined by a longitudinal notch 27 for allowing the dual-blades of slicing assembly 12 to pass through. The motorized cutting carriage 10 is inserted into a top rear aperture in main housing 20. This configuration allows for convenient removal of the cutting carriage 10, dual-blade slicing assembly 12, and food receptacle drawer 40 in order to facilitate cleaning.

Figure 3:
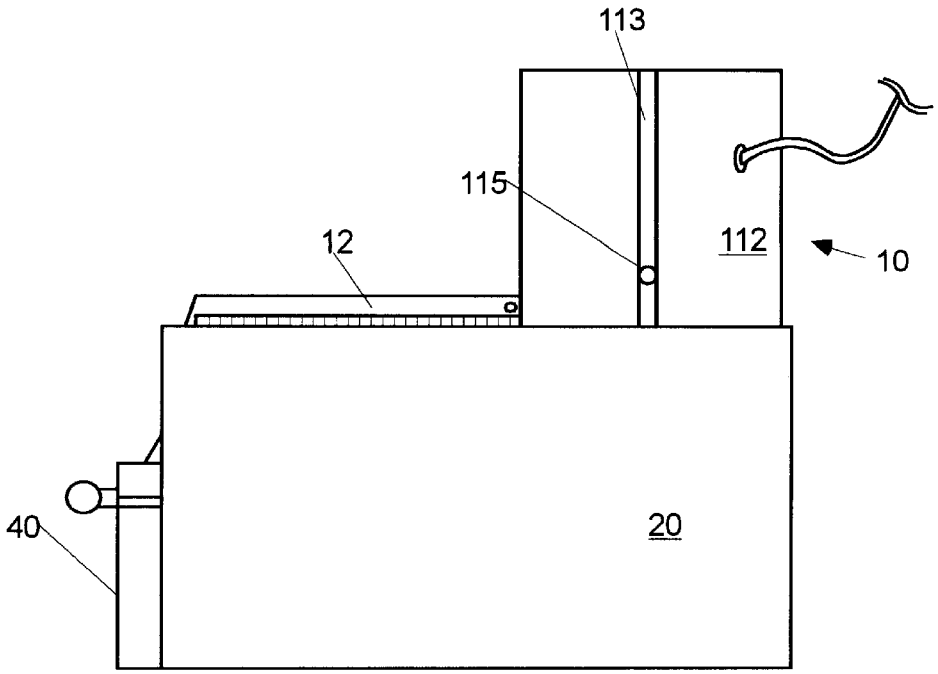
FIG. 3 is a side view of the bagel slicing appliance of FIGS. 1 and 2.
Figure 4:
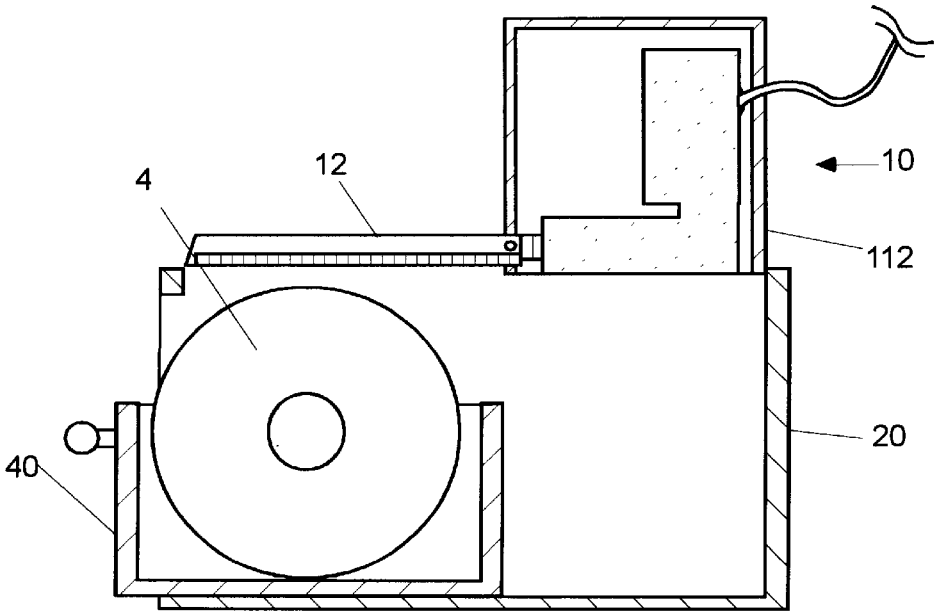
FIG. 4 is a side cut-away view of the bagel slicing appliance as in FIG. 3.

FIG. 3 is a side view of the bagel slicing appliance of FIGS. 1 and 2, and FIG. 4 is a side cut-away view of the bagel slicing appliance as in FIG. 3. Once seated in food receptacle 40 and inserted into the main housing 20, the bagel 4 or other food item becomes positioned directly underneath the blades of serrated dual-bladed slicing assembly 12. The motorized cutting carriage 10 is contained within cutting carriage housing 112 which is formed with a vertical channel 113 along one side thereof. A corresponding rib (seen in FIG. 16) protrudes interiorly in main housing 20 and fits within vertical channel 113 to guide insertion of cutting carriage housing 112. In addition, a push-contact on/off switch 115 is mounted inside the vertical channel 113. Push-contact on/off switch 115 is connected between a power source and the motorized internal drive assembly (to be described) to apply power thereto. When cutting carriage housing 112 is depressed, the rib in main housing 20 slides upward within the vertical channel 113 until it depresses on-off switch 115. This powers the internal drive mechanism to begin reciprocation of the slicing assembly 12. As the cutting carriage 10 is depressed further downward, the on/off switch 115 remains depressed and the reciprocating blades of slicing assembly 12 pass through the food item 4.

Figure 5:
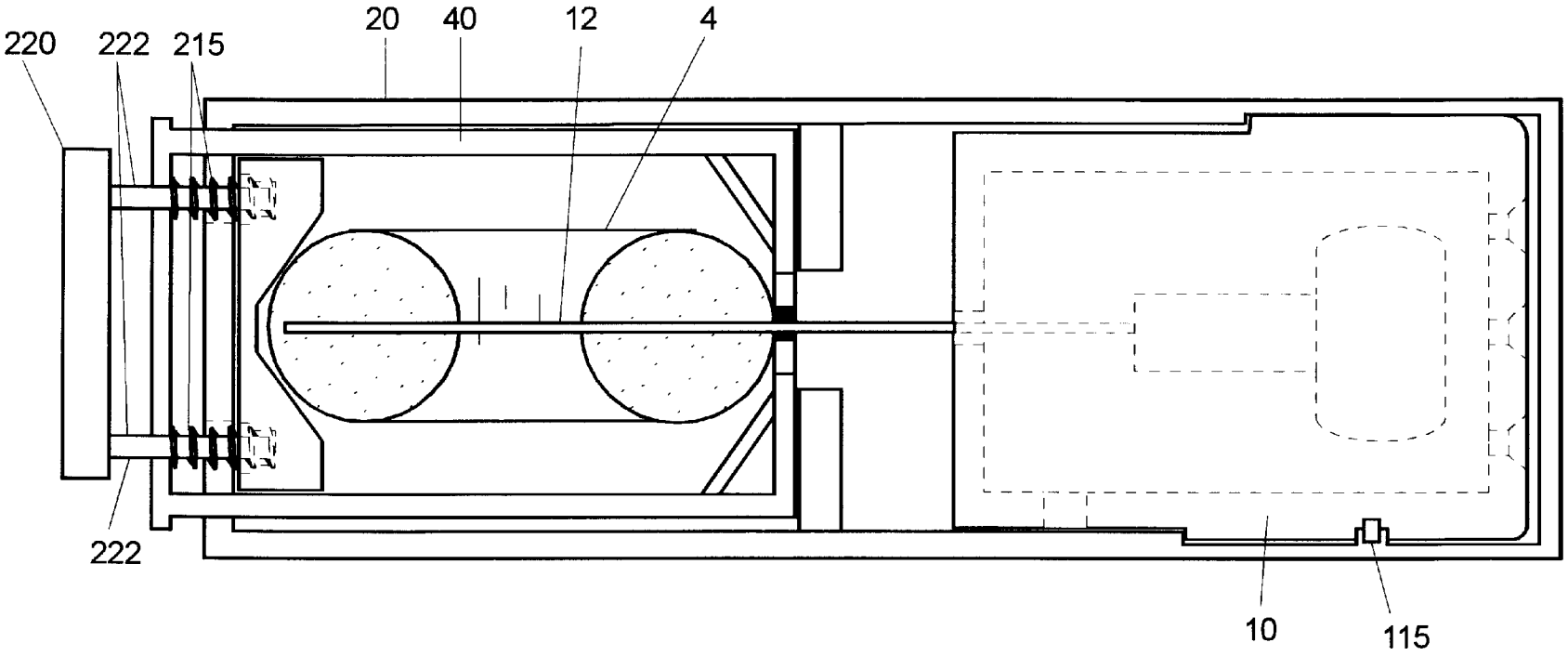
FIG. 5 is a top cut-away view of the bagel slicing appliance of FIGS. 1–4.

FIG. 5 is a top cut-away view of the bagel slicing appliance of FIGS. 1–4. It can be seen that the extension of the blades of serrated dual-bladed slicing assembly 12 over food receptacle 40 can be varied, and may be slightly shorter to leave an uncut break-apart section along the periphery of the bagel 4 (as shown), or longer to yield a complete severance of the bagel 4. The food receptacle 40 is provided with a spring-loaded handle 220 to assist with insertion. The handle 220 is mounted on posts 222 which slidably extend through the front wall of the food receptacle 40 and are anchored in a food centering block 210. Compression springs 215 are mounted on each post 222 and are sandwiched between the front wall of food receptacle 40 and food centering block 210. Food centering block 210 is formed with a concave face to center the bagel or other food item 4 within the food receptacle 40. Food centering block 210 is free to slide within the confines of the food receptacle 40, and is biased against the food item 4 by compression springs 215. This serves to position and hold the food item 4 centrally within the food receptacle.

Figure 6:
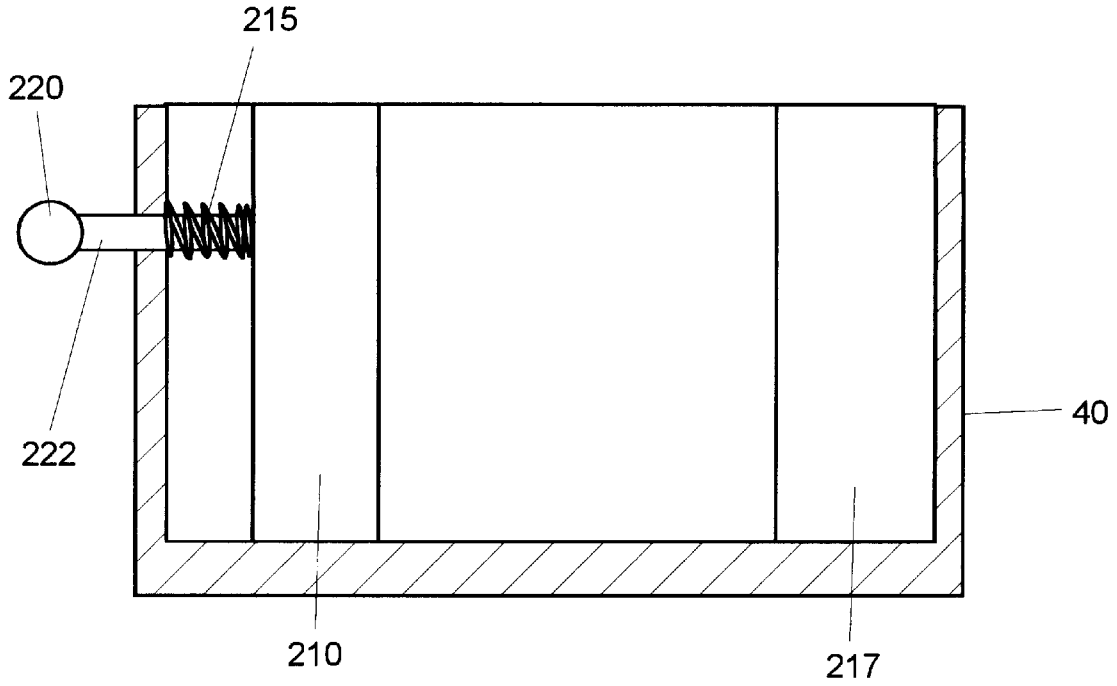
FIGS. 6–8 are an enlarged side view, front view, and top view, respectively, of the food receptacle 40 as shown in FIGS. 1 and 2.
Figure 7:
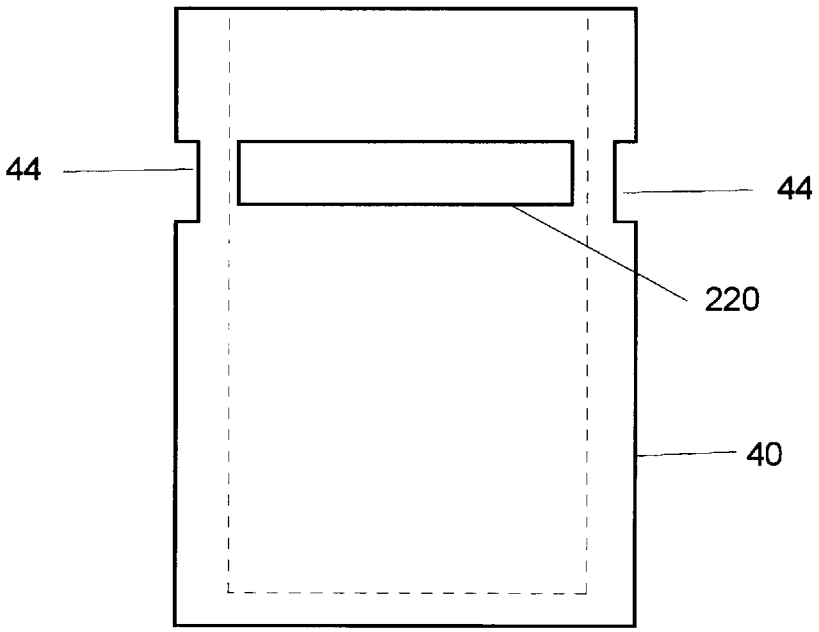
Figure 8:
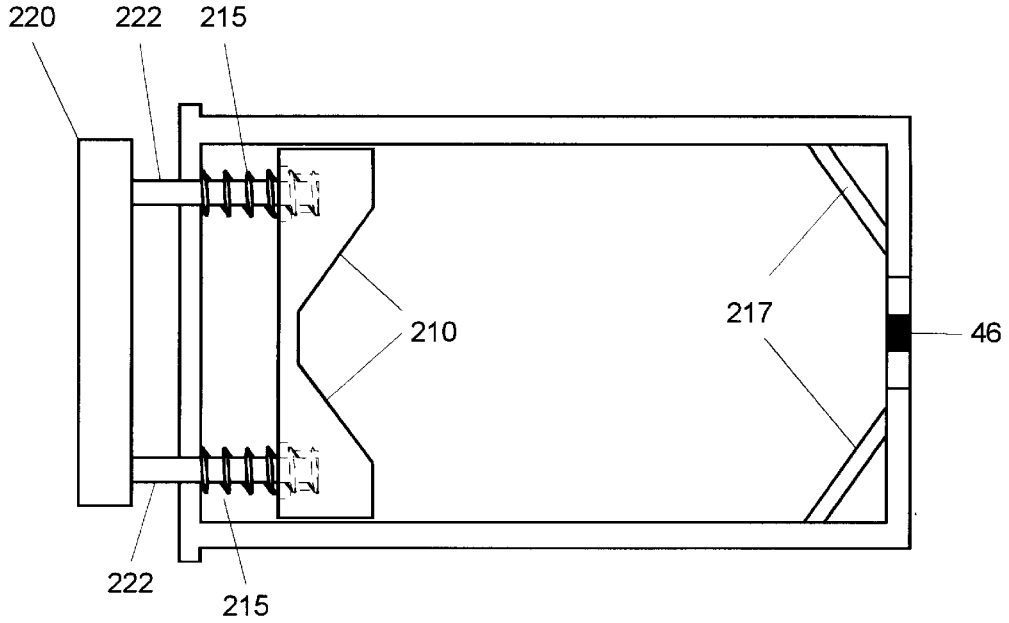

FIGS. 6–8 are an enlarged side view, front view, and top view, respectively, of the food receptacle 40 as shown in FIGS. 1–5. The food receptacle 40 is preferably molded of impact and heat-resistant plastic but may otherwise be formed of any suitable material. The food receptacle is an open-topped enclosure defined by surrounding walls and an integral bottom panel. The enclosure is of proper size and shape to receive a food article such as a bagel 4 (as seen in FIG. 2). It is presently contemplated that the exterior proportions of the food receptacle will be approximately 6" long, 3" wide, and approximately 3.5" deep in order to yield a sufficient cavity for the food. A cover (not shown) for the food receptacle 20 is preferably also provided. This may be a simple removable cover panel proportioned to fit over top of food receptacle 40 and defined by a horizontal slot for allowing downward passage of the blade assembly 12. The front wall of food receptacle 40 may be protruded slightly past the sidewalls to serve as an abutment for limiting insertion of the food receptacle in main housing 20. As seen in FIG. 7, the opposing side-walls of food receptacle 40 are defined by transverse notches 44 running the entire length thereof and adapted to receive and guide insertion via interfitting rails or ribs in the main housing 20. The rear wall of food receptacle 40 is defined by a narrow vertical slot 46 to allow sufficient clearance so that the blades of slicing assembly 12 may move through the food item.

As seen in FIG. 8, the interior compartment of the food receptacle is provided with a spring-loaded centering block 210 to assist in seating and centering food articles. Transverse stationary food centering partitions 217 are also provided at the rear of food receptacle 40 to serve the same purpose.

Figure 9:
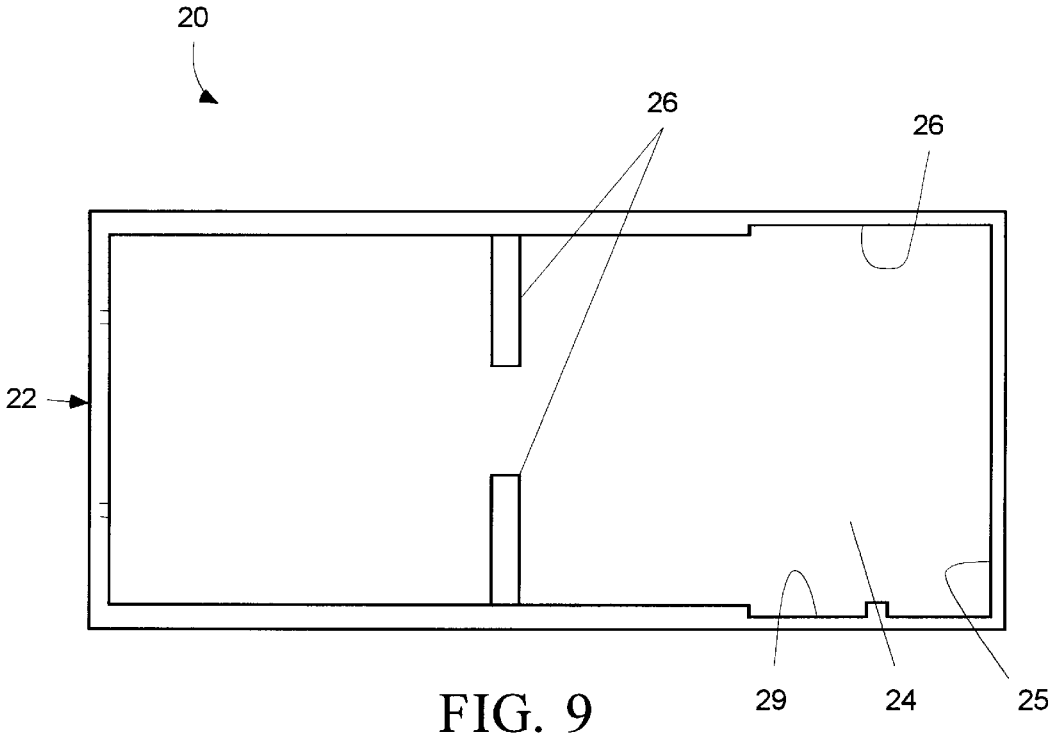
FIGS. 9–11 are an enlarged top view, front view, and side view, respectively, of the main housing 20 as shown in FIGS. 1 and 2.
Figure 10:
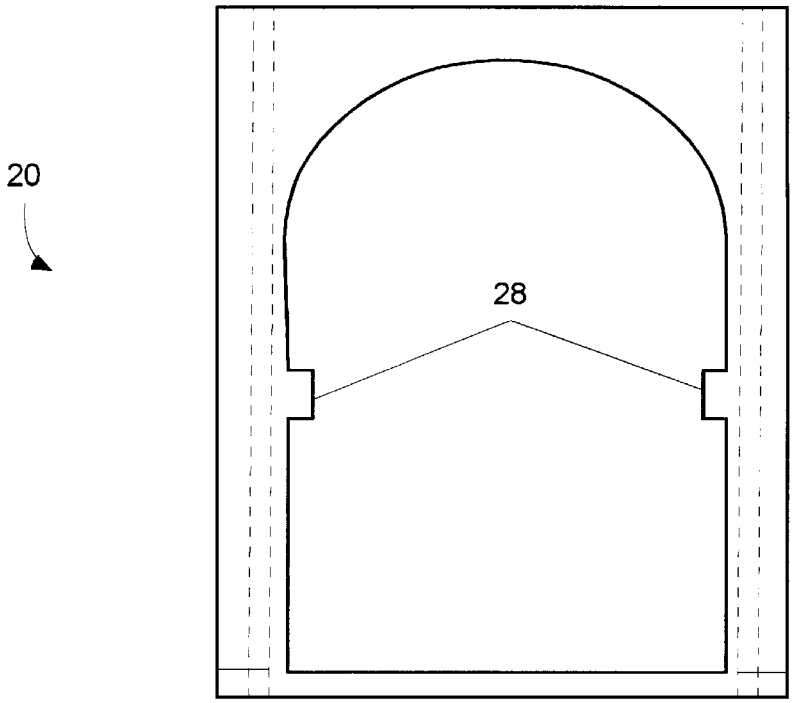
Figure 11:
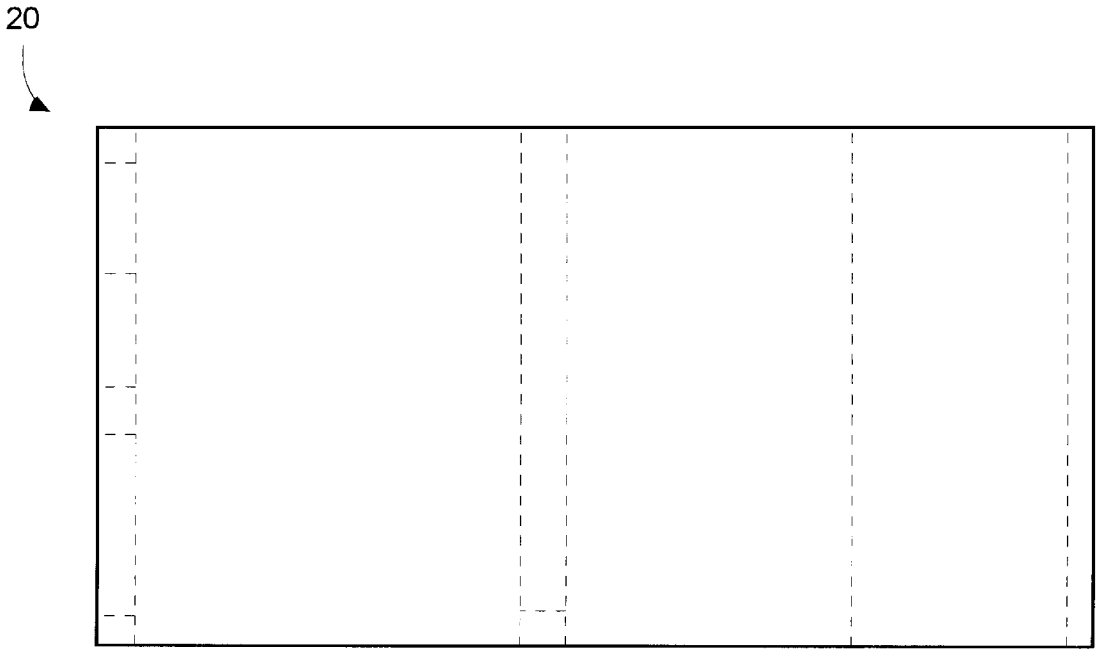

FIGS. 9–11 are an enlarged side top view, front view, and side view, respectively, of the main housing 20 as shown in FIGS. 1 and 2. The main housing 20 is preferably likewise molded of heat and impact resistant plastic, but may otherwise be formed of any suitable material. The main housing 20 is a partially covered enclosure defined by surrounding walls and an integral bottom panel. The enclosure is subdivided into two sections by a lateral partition 26. The food receptacle receiving end 22 (to the left of partition 26) is open and adapted for slidable insertion of food receptacle 40 (with bagel 4), an aperture being defined in the side wall of main housing 20 for such purpose. As seen in FIG. 10, the aperture generally conforms to the external proportions of food receptacle 40 and offers additional overhead clearance to accommodate a standard bagel or larger food item. As seen in FIG. 2, main housing 20 is preferably fitted with a top wall 23 for added safety. The top wall 23 covers approximately the food receptacle receiving end 22 (to the left of partition 26) and is defined by a longitudinal notch 27 for allowing the dual-blades of slicing assembly 12 to pass through. Lateral side rails 28 are formed on opposing side walls of main housing 20 and extend lengthwise throughout the food receptacle receiving section 22. Side rails 28 are adapted to fit within the transverse notches 44 of food receptacle 40 in order to receive and guide insertion of food receptacle 40 into the main housing 20.

A cutting carriage receiving section 24 (to the right of partition 26) is sized and adapted for downward sliding insertion of cutting carriage 10, and an aperture is defined through the top of main housing 20 for such purpose. As seen in FIG. 9, the aperture generally conforms to the external proportions of cutting carriage 10 to accommodate sliding insertion. Recessed channels 25 are provided in the opposing side-walls of cutting carriage receiving section 24, and these extend downward in order to receive and guide depression of cutting carriage 10 via interfitting raised runners 13 in the cutting carriage 10. It is presently contemplated that the exterior proportions of the main housing 20 will be approximately 13" long, 6" wide, and approximately 5.5" deep in order to yield a sufficient cavity for the food. One of the recessed channels 25 is subdivided by an elongated rib 29. Rib 29 fits within the vertical channel 113 of cutting carriage housing 112. When cutting carriage housing 112 is depressed, the rib 29 rides upward within the vertical channel 113 until it depresses on-off switch 115. This powers the internal drive mechanism to begin reciprocation of the slicing assembly 12. As the cutting carriage 10 is depressed further downward, the on/off switch 115 remains depressed by rib 29 and the reciprocating blades of slicing assembly 12 cut the food item 4.

Figure 12:
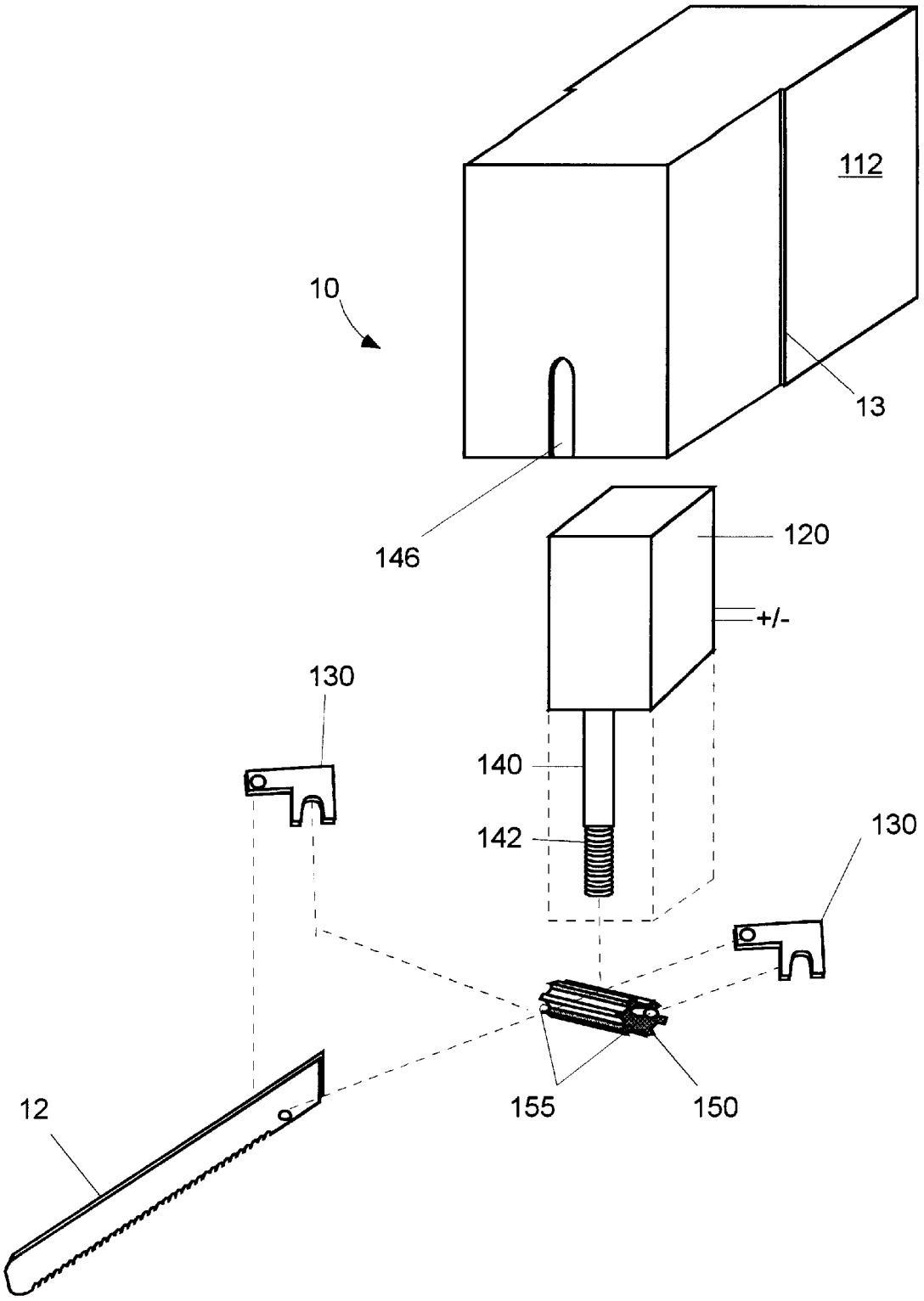
FIG. 12 is an exploded perspective view of the cutting carriage 10 as shown in FIGS. 1 and 2.

FIG. 12 is an exploded perspective view of the cutting carriage 10 as shown in FIGS. 1 and 2. Cutting Carriage 10 includes a cutting carriage housing 112, dual-serrated reciprocating blade assembly 12 anchored in the cutting carriage housing 112 and protruding therefrom, and a drive assembly mounted within the cutting carriage housing 112. The drive assembly and dual-serrated reciprocating blade assembly 12 are commercially available components typically made and sold for powering electric knives. In the present case, UL listed part no. 425C E42169 (available in a unit sold as J.C. Penney Cat. No. 784-4632) is well-suited. As seen in FIG. 12, this drive assembly generally includes a standard 100 Watt Johnson electric motor 120 with an extending drive shaft 140 turning a worm gear 142. Worm gear 142 turns an orthogonallymounted radial gear 150 having offset drive bits 155 protruding from each face. Drive bits 155 are preferably offset in diametric directions from the center axis of gear 150. Two opposing yoke brackets 130 each have a slot at one end and thereby engage one of the drive bits 155. The other ends of yoke brackets 130 extend outward and are secured to a corresponding blade of the dualSo serrated reciprocating blade assembly 12. When activated, the electric motor 120 turns drive shaft 140, which turns worm gear 142, and this turns orthogonally-mounted radial gear 150. Rotation of orthogonally-mounted radial gear 150 causes the offset drive bits 155 to rotate in a circular motion. The rotation of drive bits 155 urges the opposing yoke brackets 130 forward and backward in a reciprocating manner, and since drive bits 155 are offset in diametric directions, the movement of yoke brackets 130 is out of phase. In this manner, the yoke brackets 130 each drive one of the blades of the dual-serrated reciprocating blade assembly 12.

Of course, the above-described drive assembly and dual-serrated reciprocating blade assembly 12 are commercially available components and are described purely for exemplary purposes. It is contemplated that other satisfactory drive assemblies exist, and the use of any would be considered within the spirit and scope of the invention. It is only necessary to reassemble/reorient the drive assembly and dual-serrated reciprocating blade assembly 12 within a suitable cutting carriage housing 112 as will now be described.

Figure 13:
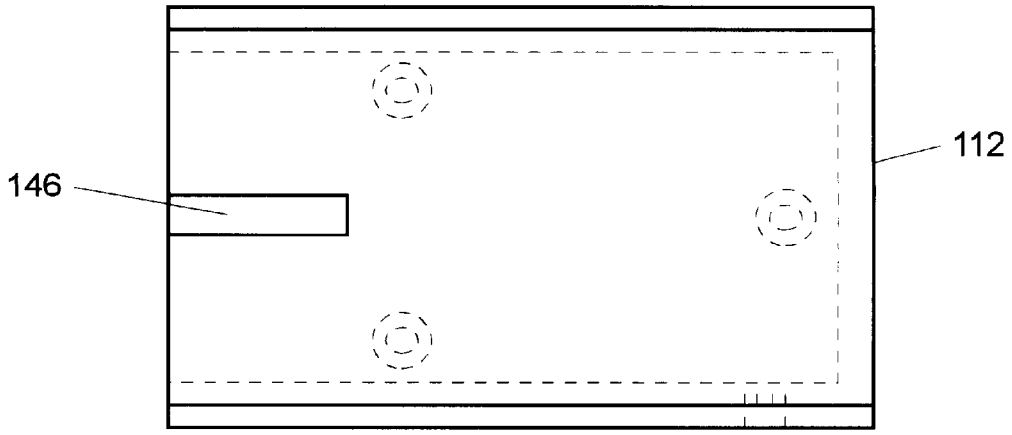
FIGS. 13–15 are an enlarged front view, side view, and top view, respectively, of the cutting carriage housing 12 as shown in FIG. 12.
Figure 14:
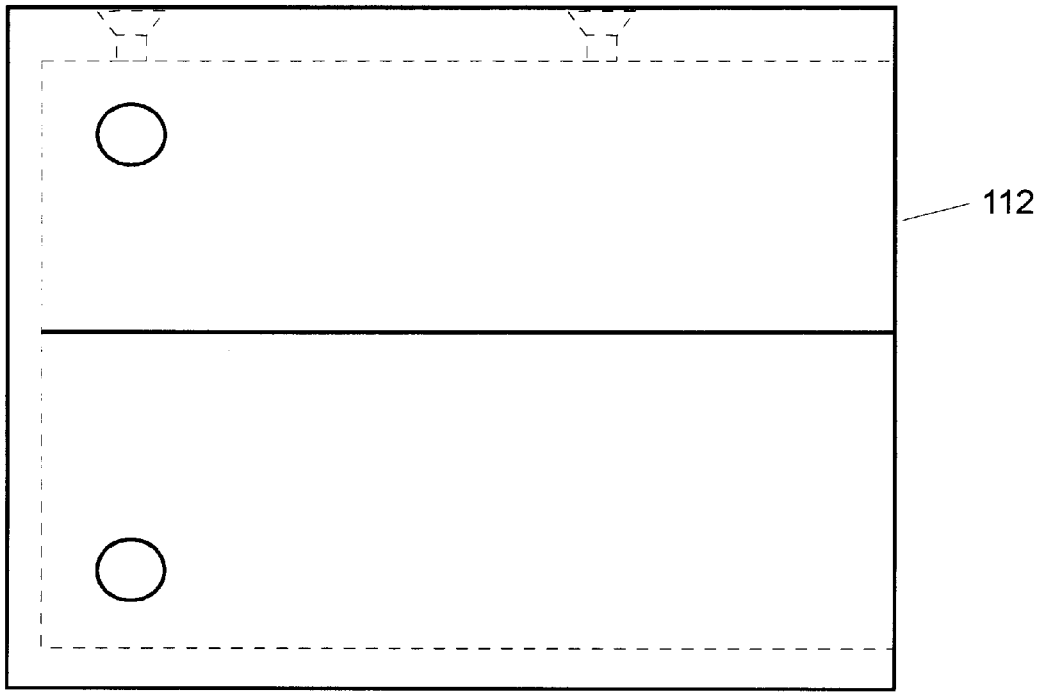
Figure 15:
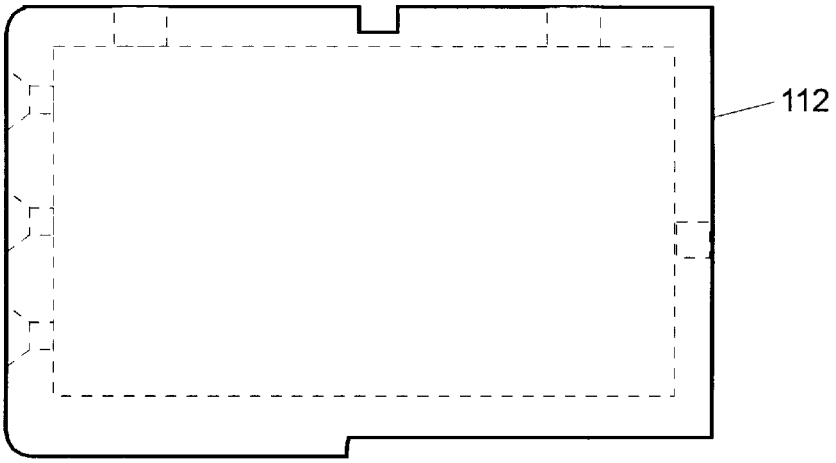

FIGS. 13–15 are an enlarged front view, side view, and top view, respectively, of the cutting carriage housing 112 as shown in FIG. 12. The cutting carriage housing 112 is preferably molded of heat and impact resistant plastic but may otherwise be formed of any suitable material. The cutting carriage housing 112 is a five-sided enclosure defined by surrounding walls and an integral top panel. The enclosure is of proper size and shape to seat and house the drive assembly (as seen in FIG. 12). It is presently contemplated that the exterior proportions of the cutting carriage housing 112 will be approximately 3.25" long, 2.75" wide, and approximately 2.5" deep in order to yield a sufficient housing for the drive assembly. The cutting carriage housing 112 is defined by pre-formed holes for screws and hardware as necessary to mount the components of the drive assembly (which forms the sixth side of the enclosure). As seen in FIG. 15 (top view), the side walls of cutting carriage housing 112 are slightly recessed at approximately their mid-point, and their periphery conforms to the aperture in the main housing 20. Raised ribs in the main housing 20 fit within the recessed side walls of cutting carriage housing 112 and help to give the cutting carriage 10 more stability as it is depressed inside of the main housing 20.

The fore wall of cutting carriage housing 112 is defined by a narrow vertical slot 146 to allow sufficient clearance so that the blades of slicing assembly 12 may extend therethrough.

Figure 16:
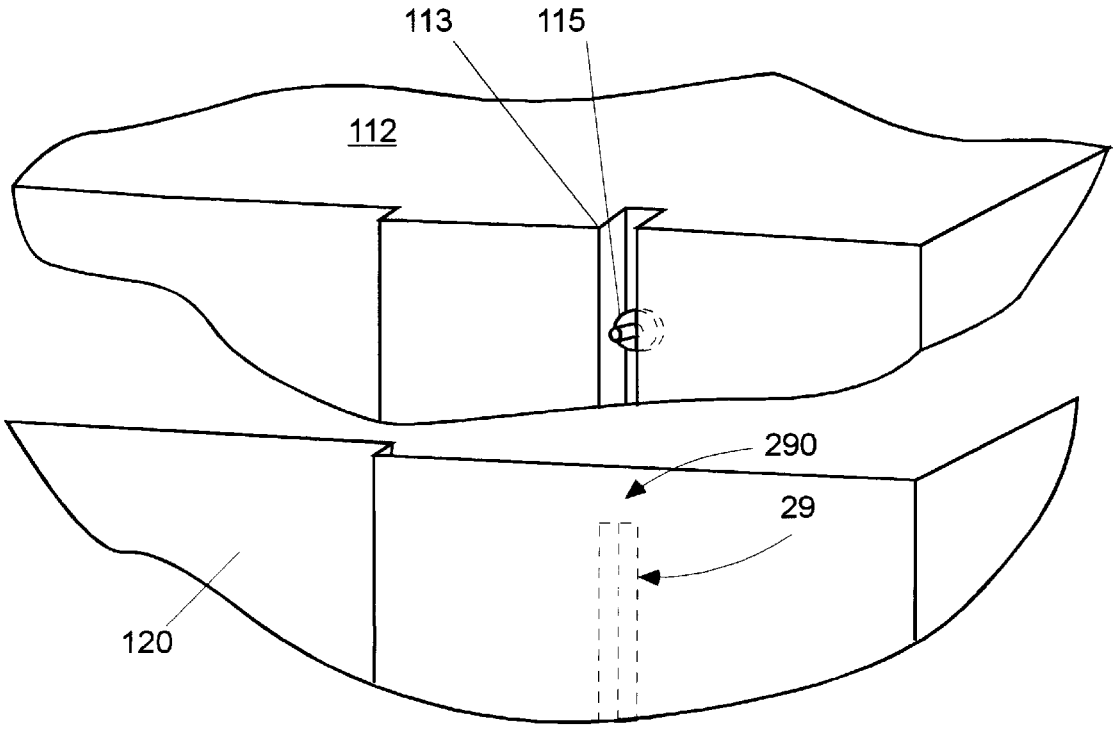
FIG. 16 is an enlarged perspective view of the vertical channel 113 formed along one side of cutting carriage housing 112, and the corresponding rib 29 in main housing 20.

FIG. 16 is an enlarged perspective view of the vertical channel 113 formed along one side of cutting carriage housing 112, and the corresponding rib 29 protruding interiorly of main housing 20 and adapted to fit within vertical channel 113 to guide insertion of cutting carriage housing 112. The push-contact on/off switch 115 is mounted inside the vertical channel 113 so that when cutting carriage housing 112 is depressed, the rib 29 in main housing 20 rises within the vertical channel 113 until it depresses on-off switch 115. The upper face of rib 29 is preferably given a beveled or ramped surface 290 for this purpose. This assembly automatically powers the internal drive mechanism to begin reciprocation of the slicing assembly 12. As the cutting carriage 10 is depressed further downward, the on/off switch 115 remains depressed by rib 29 and the reciprocating blades of slicing assembly 12 pass through the food item 4.

Figure 17:
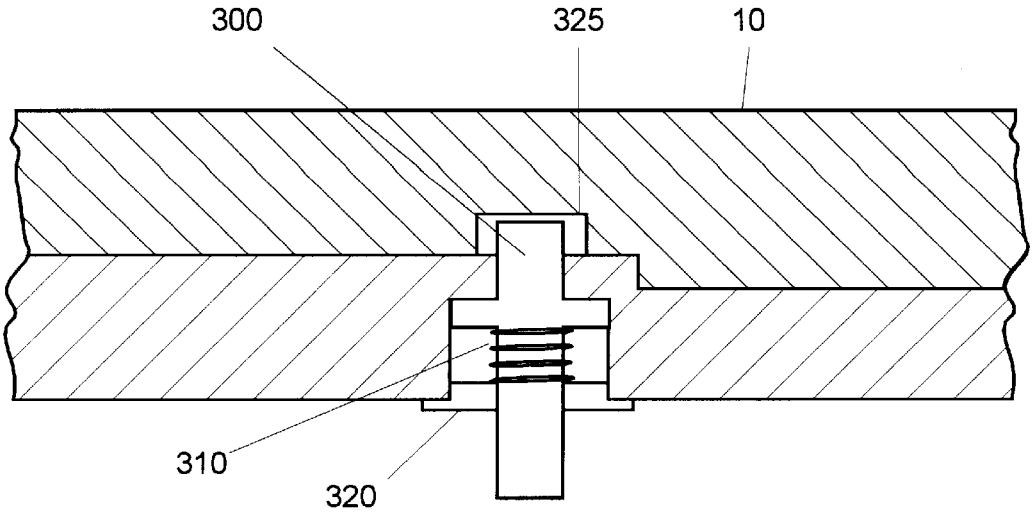
FIGS. 17 and 18 are an enlarged top perspective view and side perspective view, respectively, of the spring-loaded detent mechanism for limiting upward and downward sliding of the cutting carriage 10 within main housing 20.
Figure 18:
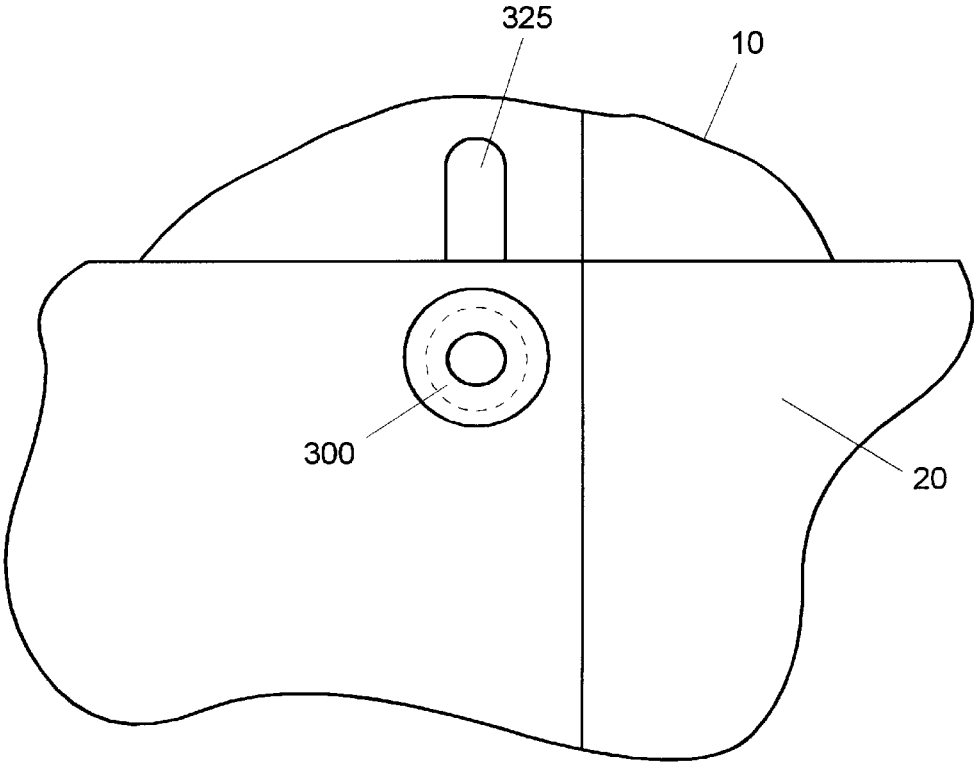

FIGS. 17 and 18 are an enlarged top perspective view and side perspective view, respectively, of the spring-detent mechanism for limiting upward and downward sliding of motorized cutting carriage 10 in main housing 20. A downward limit is necessary to prevent the dual-blade slicing assembly from bottoming out, and an upward limit prevents inadvertent extraction of the cutting carriage 10 out of the main housing 20. As seen in FIG. 17, both modes of limitation are imposed by the spring-detent mechanism, one of which is preferably provided on each side of the appliance. Each spring detent mechanism includes a detent pin 300 which is spring-loaded by compression spring 310 within a cavity in the main housing 20. A plug 320 contains the spring 310 within the cavity and biases a detent pin outward through a hole in the main housing 20. The detent pin fits into a guide notch 325 which is recessed into the side of the cutting carriage housing 10. As shown in FIG. 18, the guide notch 325 provides the boundaries for sliding of the cutting carriage housing 20. Specifically, when the cutting carriage housing 20 reaches its home (upward) position, detent pin 300 becomes lodged against the bottom of guide notch 325. When the cutting carriage housing 20 reaches its lowest position, detent pin 300 becomes lodged against the top of guide notch 325. The extent of guide notch 325 can be determined in accordance with the desired degree of travel of cutting carriage 10. To facilitate cleaning, detent pin 300 can be manually retracted to allow full withdrawal of the cutting carriage 10 for cleaning.

Cutting carriage 10 is preferably spring-loaded by underlying compression spring(s) (not shown) such that after manual depression it will automatically return itself to the illustrated home position.

Figure 19:
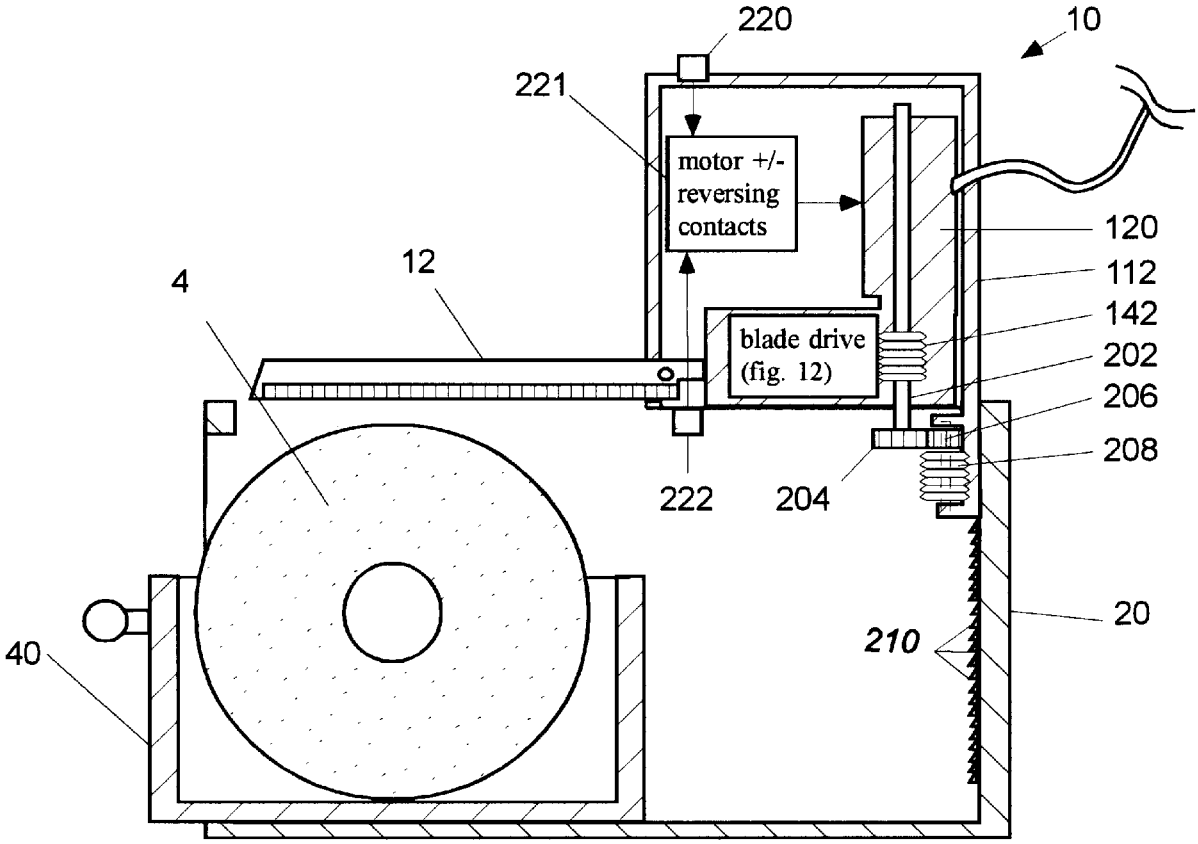
FIG. 19 is a side cut-away view of a second embodiment of the bagel slicing appliance according to the present invention with a self-driven cutting carriage 10 and gear assembly therefor.

FIG. 19 is a side cut-away view of a second embodiment of the bagel slicing appliance according to the present invention with a self-driven cutting carriage 10 and gear assembly therefor. The main housing 20 and food receptacle drawer 40 are similar in most all respects to the embodiment of FIGS. 1–18, and likewise a motorized cutting carriage 10 is mounted on top of the main housing 20. However, in the present embodiment a gear and switching assembly is included for self-driving the cutting carriage 10 into and out of the housing 20. The cutting carriage 10 automatically lowers itself for cutting the bagel and returns itself to the illustrated home position. The identical dual-bladed slicing assembly 12 is employed, and is actuated by the same blade drive assembly of FIG. 12 for reciprocating the blades and slicing through the food item 4.

The push-contact on/off switch 115 of FIGS. 1–18 is eliminated. In this second embodiment, the switching assembly for actuating the self-driving cutting carriage 10 into and out of the main housing 20 comprises a start switch 220 mounted atop the carriage 10 for manual depression, and a reverse switch 222 protruding from the bottom of the carriage 10 for self-reversing of motor 120 upon contact with the floor of main housing 20. Upon depression of the start switch 220 mounted atop the carriage 10, the internal drive mechanism begins reciprocation of the slicing assembly 12 and initiates lowering of the self-driven cutting carriage 10 until the reciprocating blades of slicing assembly 12 pass through the food item 4. When the cutting carriage 10 reaches the bottom of the main housing (at which point the bagel is completely sliced), the reverse switch 222 protruding from the bottom of the carriage 10 is depressed by the floor of the main housing 10 and automatically reverses motor 120. While in reverse, the cutting carriage 10 automatically returns itself to the illustrated home position.

The start switch 220 and reverse switch 222 are conventional push-switches with contacts 221 connected between the motor 120 and its power and ground inputs +/− for forward and reverse application of power thereto upon depression in the above-described manner.

The self-driven cutting carriage 10 gear assembly expands upon the motor 120 and blade drive assembly as shown in FIG. 12. In this self-driven embodiment, the axle 202 of motor 120 is extended downwardly beyond the first worm gear 142 of the blade drive assembly. A first radial gear 204 is mounted on the distal tip of axle 202 beneath first worm gear 142. The first radial gear 204 meshes with a second worm drive assembly which serves to lower the cutting carriage housing 10. The second worm drive assembly comprises a second radial gear 206 driven by the first radial gear 204. The second radial gear 206 is rotatably mounted on an axle above a second worm gear 208, and these gears are secured to rotate together. The axle carrying the second radial gear 206 and second worm gear 208 is carried by collars, yokes or the like which protrude inwardly from the wall of cutting carriage housing 10. A window is provided in the cutting carriage housing 10 between the collars or yokes to allow a portion of the second worm gear 208 to protrude rearwardly from within the cutting carriage housing 10. The protruding teeth of the second worm gear 208 mesh with a vertical ratchet gear strip 210 which may be integrally molded or otherwise secured vertically along the rear wall of the main housing 20. The ratchet gear strip 210 comprises a simple vertical row of teeth which mesh with the second worm gear 208.

In operation, a user depresses start switch 220, and the internal drive mechanism begins rotation of the axle 202 of motor 120 and reciprocation of the slicing assembly 12. In addition, go the first radial gear 204 mounted on the distal tip of axle 202 begins to rotate and meshes with the second radial gear 206. The second radial gear 206 in turn rotates the second worm gear 208, which in turn meshes with the teeth of vertical ratchet gear 210 on main housing 20. This pulls the cutting carriage 10 downwardly within the main housing 10 until the reciprocating blades of slicing assembly 12 pass through the food item 4. When the cutting carriage 10 reaches the bottom of the main housing and the food item is completely sliced, the reverse switch 222 protruding from the bottom of the carriage 10 is sandwiched by the floor of the main housing 10 and by operation of the motor reversing contacts 221 automatically reverses motor 120. This self-driven gear and switching assembly automatically returns the cutting carriage 10 to the illustrated home position, at which point the motor reversing contacts 221 turn the motor off.

Figure 20:
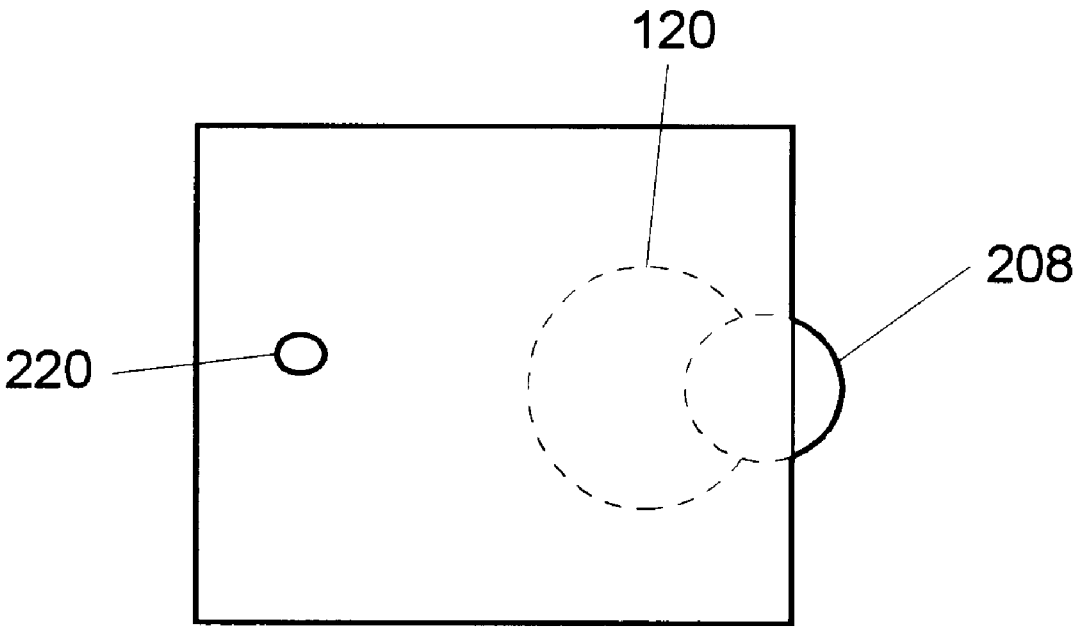
FIG. 20 is a top view of the self-driven cutting carriage 10 of FIG. 19 illustrating the lateral positioning of motor 120 and worm gear 208.

FIG. 20 is a top view of the self-driven cutting carriage 10 of FIG. 19 illustrating the lateral positioning of motor 120 and worm gear 208 for driving cutting carriage 10. It can be seen how a portion of the second worm gear 208 protrudes rearwardly from within the cutting carriage housing 10 via a window in the rear wall of cutting carriage housing 10 to thereby allow the second worm gear 208 to mesh with the ratchet gear strip 210 of main housing 20.

Figure 21:
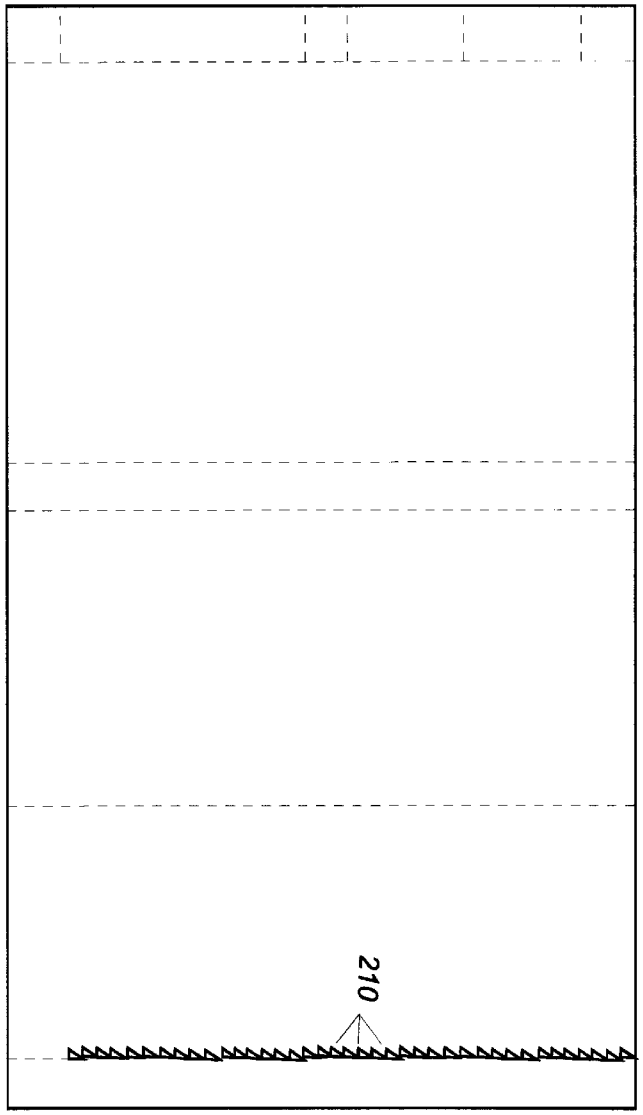
FIG. 21 is an enlarged side view of the-main housing of FIG. 19, which is similar to that of FIG. 11 and additionally includes a ratchet gear strip 210 for driving cutting carriage 10.

FIG. 21 is an enlarged side view of the main housing 20 of FIG. 19. The main housing 20 is substantially similar to that of FIG. 11 and additionally includes the ratchet gear strip 210 as described above for driving cutting carriage 10.

The entire cutting operation becomes fully automatic with this embodiment, and the user can enjoy the greatest degree of convenience and safety.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

We claim:

1. A food slicing appliance for cutting bagels, baked goods and other food items, comprising:

a main housing for providing support on an existing surface, said main housing defining a walled enclosure having a side aperture and a top aperture;

a food receptacle providing a walled compartment for seating a food item, said food receptacle being adapted for slidable insertion into the side aperture of said main housing, and said food receptacle having a notch extending downwardly into a leading wall thereof, a cutting carriage adapted for slidable insertion into the top aperture of said main housing, said cutting carriage further including, a cutting carriage housing, an electric motor mounted within said cutting carriage housing for providing rotary drive, a slicing assembly mounted within said cutting carriage housing, said slicing assembly including an elongate reciprocating blade protruding laterally from said cutting carriage, said blade being disposed over the food receptacle when said food receptacle is inserted into the side aperture of said main housing, and a drive mechanism mounted in said cutting carriage and coupled between said electric motor and reciprocating blade for translating the rotary drive into blade reciprocation to facilitate slicing through the food item;

whereby a food item may be seated in said food receptacle, said food receptacle may be slidably inserted into the side aperture of said main housing, and said cutting carriage may be slidably depressed downward into the top aperture of said main housing for driving said reciprocating blade down through said notch in said food receptacle and through the food item seated therein for slicing of the food item.

2. A food slicing appliance for cutting bagels, baked goods and other food items, comprising:

a main housing for providing support on an existing surface, said main housing defining a walled enclosure having a side aperture and a top aperture, and a ratchet gear strip extending interiorly downward;

a food receptacle providing a walled compartment for seating a food item, said food receptacle being adapted for slidable insertion into the side aperture of said main housing, and said food receptacle having a notch extending downwardly into a leading wall thereof, a cutting carriage adapted for slidable insertion into the top aperture of said main housing, said cutting carriage further including, a cutting carriage housing, an electric motor mounted within said cutting carriage housing for providing rotary drive, a slicing assembly mounted within said cutting carriage housing, said slicing assembly including an elongate reciprocating blade protruding laterally from said cutting carriage, said blade being disposed over the food receptacle when said food receptacle is inserted into the side aperture of said main housing, and a drive mechanism mounted in said cutting carriage and coupled between said electric motor and reciprocating blade for translating the rotary drive into blade reciprocation to facilitate slicing through the food item, and a cutting carriage drive assembly including a start switch for manually activating said electric motor, a gear coupling between said electric motor and the ratchet gear strip of said main housing for drawing said cutting carriage into the main housing when said motor is activated, and a reverse switch activated upon full insertion of said cutting carriage into the main housing to reverse rotation of said electric motor, thereby operating said gear coupling to automatically return said cutting carriage to a home position;

whereby a food item may be seated in said food receptacle, said food receptacle may be slidably inserted into the side aperture of said main housing, said electric motor may be activated by said start switch to draw the cutting carriage into the main housing via the gear coupling with said ratchet gear strip, thereby driving said reciprocating blade down through the notch in said food receptacle for slicing of the food item seated therein, whereupon said reverse switch is automatically activated to reverse rotation of said electric motor and automatically return said cutting carriage to a home position.

3. The food slicing appliance of claim 1, wherein said food receptacle further comprises:

spring-biased centering means for centering a food article upon insertion into said food receptacle.

4. The food slicing appliance of claim 3, wherein said spring-biased centering means comprises:

a food centering block formed with a concave face to center the food item within the food receptacle, and at least one compression spring for biasing the food centering block against the food item.

5. The food slicing appliance of claim 4, wherein said spring-biased centering means further comprises:

a handle extending outward from the front wall of said food receptacle, said handle having two rearward extending posts extending through the front wall of said food receptacle and attached to said food centering block; and said at least one compression spring further comprises a pair of compression springs, each spring being mounted on a corresponding one of said two rearward extending handle posts between said food centering block and the front wall of said food receptacle;

whereby said handle may be pulled outward from the food receptacle against the force of said spring biasing means to allow insertion of a food article and may be released to center said food article against said food centering block.

6. The food slicing appliance of claim 4, wherein said food receptacle further comprises:

a transverse notch along one side of the food receptacle for engagement with a guide rail disposed on the interior wall of said main housing, whereby said transverse notch and said guide rail interfit upon insertion of the food receptacle into said main housing to guide insertion of the food receptacle.

7. The food slicing appliance of claim 1, wherein said main housing further comprises a vertical rib placed along the interior wall of said main housing.

8. The food slicing appliance of claim 7, wherein said cutting carriage further comprises a vertical channel disposed within said cutting carriage housing for slidably engaging said vertical rib on said main housing; and said food slicing appliance includes a motor actuating switch disposed within said vertical channel for actuating said electric motor;

whereby as the cutting carriage housing is slidably depressed downward into the top aperture of said main housing, said vertical rib in said main housing is inserted into said vertical channel on said cutting carriage and engages said motor actuating switch to initiate operation of said electric motor.

9. The food slicing appliance of claim 1, wherein said food slicing appliance further comprises a motion limiting means in said main housing for limiting the vertical movement of said cutting carriage housing.

10. The food slicing appliance of claim 9, wherein said motion limiting means further comprises:

a detent pin disposed in a side wall of said main housing, said detent pin extending interiorly in the side wall of said main housing for engagement with said cutting carriage housing;

said cutting carriage housing being configured to engage said detent pin to thereby limit a slidable range of said cutting carriage housing.

11. The food slicing appliance of claim 2, wherein said food slicing appliance further comprises:

spring-biased centering means for centering a food article upon insertion into said food receptacle.

12. The food slicing appliance of claim 11, wherein said spring-biased centering means comprises:

a food centering block formed with a concave face to center the food item within the food receptacle, and at least one compression spring for biasing the food centering block against the food item.

13. The food slicing appliance of claim 12, wherein said spring-biased centering means further comprises:

a handle extending outward from the front wall of said food receptacle, said handle having two rearward extending posts extending through the front wall of said food receptacle and attached to said food centering block; and said at least one compression spring further comprises a pair of compression springs, each spring being mounted on a corresponding one of said two rearward extending handle posts between said food centering block and the front wall of said food receptacle;

whereby said handle may be pulled outward from the food receptacle against the force of said spring biasing means to allow insertion of a food article and may be released to center said food article against said food centering block.

14. The food slicing appliance of claim 2, wherein said food receptacle further comprises:

a transverse notch along one side of the food receptacle for engagement with a guide rail disposed on the interior wall of said main housing, whereby said transverse notch and said guide rail interfit upon insertion of the food receptacle into said main housing to guide insertion of the food receptacle.

15. The food slicing appliance of claim 2, wherein said main housing further comprises a vertical rib placed along the interior wall of said main housing.

16. The food slicing appliance of claim 15, wherein said cutting carriage further comprises a vertical channel disposed within said cutting carriage housing for slidably engaging said vertical rib on said main housing; and said food slicing appliance includes a motor actuating switch disposed within said vertical channel for actuating said electric motor;

whereby as the cutting carriage housing is slidably depressed downward into the top aperture of said main housing, said vertical rib in said main housing is inserted into said vertical channel on said cutting carriage and engages said motor actuating switch to initiate operation of said electric motor.

17. The food slicing appliance of claim 2, wherein said food slicing appliance further comprises a motion limiting means in said main housing for limiting the vertical movement of said cutting carriage housing.

18. The food slicing appliance of claim 17, wherein said motion limiting means further comprises:

a detent pin disposed in a side wall of said main housing, said detent pin extending interiorly in the side wall of said main housing for engagement with said cutting carriage housing;

said cutting carriage housing being configured to engage said detent pin to thereby limit a slidable range of said cutting carriage housing.

* * * * *